US007982410B2

(12) United States Patent
Adenau

(10) Patent No.: US 7,982,410 B2
(45) Date of Patent: Jul. 19, 2011

(54) ELECTRONIC DIMMER CIRCUIT

(75) Inventor: Michael Adenau, Würzburg (DE)

(73) Assignee: MA Lighting Technology GmbH, Waldbuttelbrunn (DE)

( * ) Notice: Subject to any disclaimer, the term of this patent is extended or adjusted under 35 U.S.C. 154(b) by 327 days.

(21) Appl. No.: 12/388,406

(22) Filed: Feb. 18, 2009

(65) Prior Publication Data

US 2010/0207545 A1 Aug. 19, 2010

(51) Int. Cl.
*H05B 37/02* (2006.01)

(52) U.S. Cl. ..... 315/295; 315/307; 315/DIG. 4

(58) Field of Classification Search ..... 315/DIG. 4, 315/DIG. 5, 291, 307, 294, 295, 297, 299, 315/308

See application file for complete search history.

(56) References Cited

U.S. PATENT DOCUMENTS

| | | | | |
|---|---|---|---|---|
| 6,873,121 | B1 * | 3/2005 | Stevens | 315/307 |
| 7,265,503 | B2 * | 9/2007 | Green | 315/308 |
| 7,391,167 | B2 * | 6/2008 | Jang et al. | 315/291 |
| 7,411,359 | B2 * | 8/2008 | Chung et al. | 315/291 |

* cited by examiner

*Primary Examiner* — David Hung Vu

(74) *Attorney, Agent, or Firm* — Schwegman, Lundberg & Woessner, P.A.

(57) ABSTRACT

An electrical dimmer circuit comprising the electrical dimmer circuit for dimming the electrical power of a plurality of lighting means having at least one digital input channel, at which digital low-voltage input signals for specifying the light power of the various lighting means can be received, and having at least two output channels, on which output signals for dimming the electrical power of the respectively assigned lighting means can be output by pulse width modulation of a high alternating voltage.

11 Claims, 1 Drawing Sheet

ELECTRONIC DIMMER CIRCUIT

Figure 1:
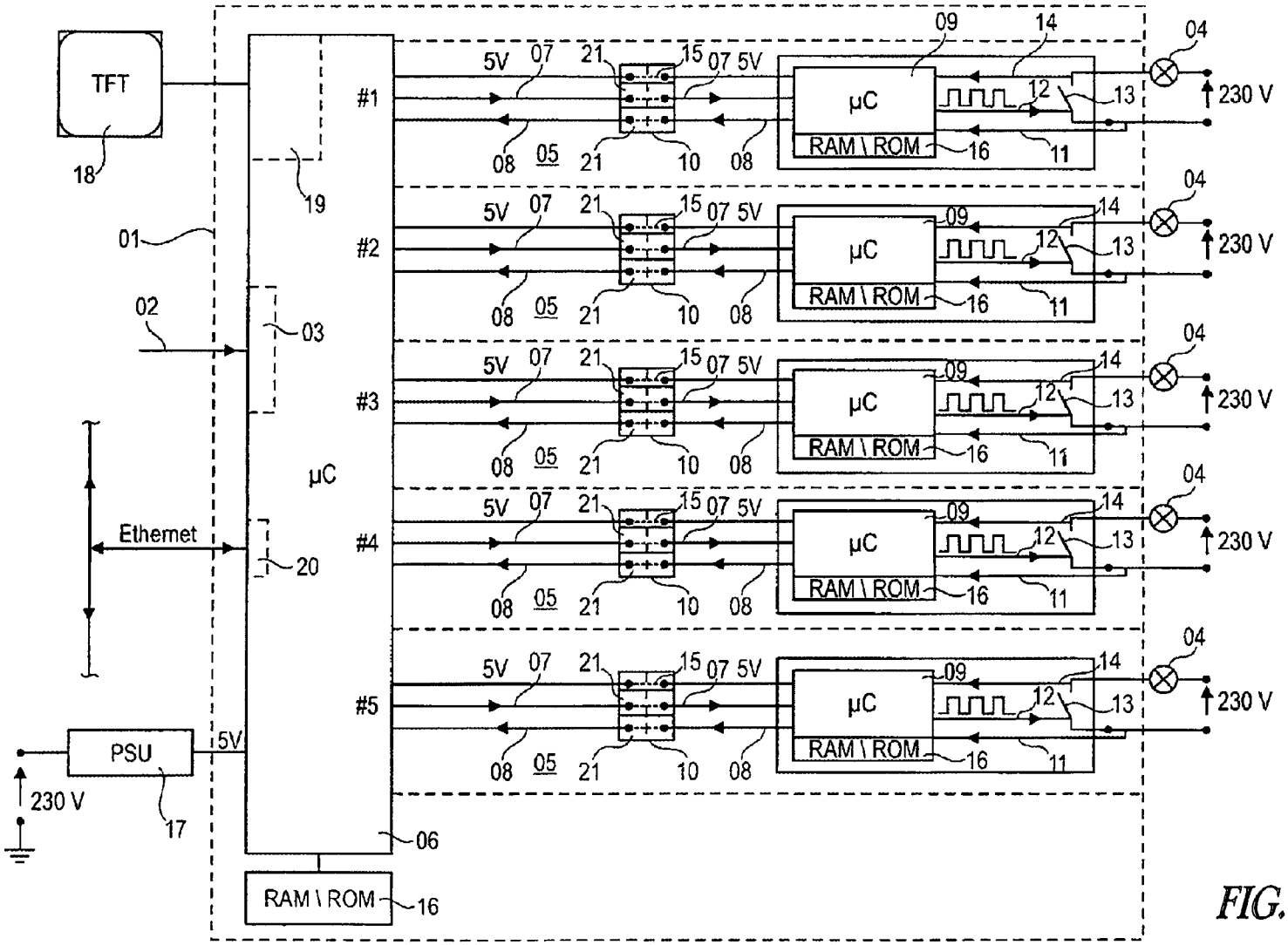

The invention relates to an electronic dimmer circuit for dimming the electrical power of a plurality of lighting means.

Generic dimmer circuits are used to control the brightness of lighting means, for example stage spotlights. The particular feature of such generic dimmer circuits is that they are suitable for dimming a plurality of lighting means. This means that a plurality of lighting means can be connected to the electronic dimmer circuit so that the brightness of the various lighting means can be adjusted by operating the dimmer circuit.

A further feature of the generic dimmer circuits is that they are equipped with at least one digital input channel for receiving low-voltage input signals, in the voltage range of 5 V for example, which specify the light output of the various lighting means. In other words, this means that the input channel of the dimmer circuit is used for transmitting the data that determines the respective brightness of each individual lighting means. For example, these low-voltage input signals that are received on the input channel may be generated by a lighting control console to create a given lighting effect on a stage.

In the generic dimmer circuits, the light output from the lighting means is varied by pulse width modulation of a high alternating voltage, for example an alternating voltage of 110 Volt or 230 Volt. In these known phase controlled modulators or inverse phase controlled modulators, the electrical current is blocked or allowed to pass by a semiconductor switch, for example a triac, depending on its phase. After each zero crossing by the alternating voltage, the switch blocks the current or allows it to pass until it receives a signal to do so. After this point, the consumer is either energized or de-energized again. The power absorbed by the lighting means is varied in accordance with the switching time of the switch. In this context, the power absorbed by the lighting means corresponds to the integral under the alternating voltage curve for the periods during which the switch allows energy to pass. In the generic dimmer circuits, the output signals that are required for pulse width modulation so that the switch can be controlled are output as output signals at the various output channels.

The known electronic dimmer circuits for dimming the electrical outputs of a plurality of lighting means are equipped with a low-voltage microcontroller which receives the low-voltage input signals and uses them to calculate the pulse width modulation for the various output channels. The output signals issuing from this low-voltage microcontroller and being low-voltage output signals are then forwarded to an optocoupler so that the various low-voltage output signals can be transferred to the high-voltage side. The high-voltage output signals that result from these on the high-voltage side are then forwarded to the switch for pulse width modulation of the high alternating voltage in order to control the electrical power of the lighting means that are assigned to the various output channels.

The disadvantage of the known electronic dimmer circuits is that relatively sophisticated circuitry is required in order to obtain information about the electrical states after the optocoupler, for example whether the switch for pulse width modulation of the high alternating voltage is functioning at all, and to forward this information to the low-voltage microcontroller, because the optocoupler, which is intended to separate the voltage potentials, only allows signals to be transmitted in one direction. Thus, if measurement data is also obtained on the high alternating voltage side, a separate optocoupler and additional electronic circuitry are needed in order to transfer this measurement data to the low-voltage microcontroller in each case, and if many output channels are involved, the additional circuitry required can be very considerable.

A further drawback of the known dimmer circuits is that the zero crossing of the high alternating voltage, which is essential for calculating the pulse width modulation, must be transferred to the low voltage microcontroller, since this is where the pulse width modulation is calculated.

Based on this related art, the object of the present invention is therefore to suggest a novel electronic dimmer circuit with which sensor data may be measured and transmitted simply on the high alternating voltage side. Moreover, it is designed to avoid the need to transfer the zero crossing signal to the low-voltage microcontroller that receives and processes the low-voltage input signals to yield a specification for the light power.

This object is attained with an electronic dimmer circuit according to the teaching of claim 1.

Advantageous embodiments of the invention are the object of the subordinate claims.

The dimmer circuit according to the invention is based on the fundamental idea of providing one microcontroller on the high-voltage side for each output channel in addition to the low-voltage microcontroller, and this microcontroller will be referred to in the following as the high-voltage microcontroller. Each of these high-voltage microcontrollers is connected to the low-voltage microcontroller via at least two data links. The first data link transmits control data from the low-voltage microcontroller to the high-voltage microcontroller, for example to transfer the low-voltage input signals received from the low-voltage microcontroller to the high-voltage microcontroller for the specification of the light power in the respective output channel. On the first data link, the data flows from the low-voltage microcontroller to the high-voltage microcontroller. The second data link is intended particularly for transmitting sensor data, which is collected by the high-voltage microcontroller on the high alternating voltage side and is then transmitted to the low-voltage microcontroller. Since the high-voltage microcontroller works at a much higher voltage level than the low-voltage microcontroller, a separating element is interposed in each of the data links to separate the voltage potentials between the high-voltage microcontroller and the low-voltage microcontroller.

The circuit topology according to the invention makes it possible ultimately to collect an unlimited quantity of sensor data in each output channel on the high alternating voltage side, which data may then be collected and processed further in the high-voltage microcontroller. This sensor data may then be transmitted in processed form to the low-voltage microcontroller via the second data link, so that only one separating element is required for separating the voltage potentials in each output channel, regardless of the quantity of sensor data collected.

This also dispenses with the need to transfer the high alternating voltage zero crossing signal to the low-voltage microcontroller, since this signal is transferred to the high-voltage microcontroller and may be processed further there in accordance with a prescribed control strategy.

In general, any electronic component may be used to serve as the separating element. Magnetic couplers or optocouplers are particularly advantageous, since they provide galvanic separation of the data signals transmitted via the data links.

For the function of the high-voltage microcontroller, it is important to ensure that the supply voltage remains as constant as possible. Such a constant supply voltage is provided on the side of the low-voltage microcontroller in any case, since the low-voltage microcontroller also requires such a supply voltage. It is therefore particularly advantageous if the separating element has a transmission channel that enables this supply voltage to pass from the low-voltage microcontroller to the high-voltage microcontroller in a galvanically separated manner. To this end it is particularly advantageous to use DC-DC converters equipped with galvanic separation between the low-voltage side and the high-voltage side.

In order to be able to inform the user about the current status of the dimmer circuit, it is particularly advantageous if a display device, for example a color TFT display, is connected to the dimmer circuit. It is especially advantageous to connect the display device to the low-voltage microcontroller, since the graphical data for operating the display device must also be transmitted at a low voltage level.

The resolution of the display device should preferably be at least 320×240 pixels (QVGA). Of course, it is also conceivable to use display devices with higher resolution capability, for example 640×480 (VGA).

In order to simplify the electronic dimmer circuit, it is particularly advantageous if the graphics processor for calculating the graphical data for the display device is integrated in the low-voltage microcontroller. In this way, a separate graphics card is not needed to operate the display device.

In general, the data for specifying the electrical power of the various lighting means may be transmitted to the dimmer circuit in any way. It is particularly advantageous if a DMX data interface is provided in the digital input channel to receive DMX signals for specifying the light power of the lighting means. DMX control signals of such kind are normally output by lighting control consoles. The electrical power of the lighting means may then be adjusted up or down according to the value of the DMX signal transmitted on the respective channel.

According to the invention, the sensor data regarding the state in the high alternating voltage range is transmitted by the high-voltage microcontroller to the low-voltage microcontroller via the second data link. This sensor data may then be processed further in the low-voltage microcontroller, and for example sensor data outputs from the various output channels may be compared with each other. To enable yet more detailed evaluation of the sensor data, it is particularly advantageous if the low-voltage microcontroller also has a data interface for forwarding the data, particularly sensor data, that is received from the high-voltage microcontroller. In this way, the sensor data may be transmitted for example to a higher level lighting control console, for further processing and evaluation.

In general, the data interface in the low-voltage microcontroller may be of any design. However, it is preferably a network interface that may be constructed for example in compliance with the Ethernet network standard. Other data, particularly input signals for controlling brightness, may also be transmitted via this network interface.

A particularly simple circuit for calculating pulse width modulation is created when the high-voltage microcontroller is connected via a measuring line to the high alternating voltage for supplying the lighting means in an output channel. Then, for example, the zero crossing for the alternating voltage may be measured via this measuring line, and may also be evaluated for pulse width modulation in the high-voltage microcontroller. In other words, this means that when the input signal of, for example, 230 V, is measured, the zero crossing signal is also evaluated. In addition, sensor circuits for measuring current, voltage and/or temperature may be created relatively easily.

It is particularly advantageous if the dimmer circuit is arranged on a single board, which may be produced and tested as an entire circuit.

An embodiment of the invention is shown schematically in the drawing and will be explained in an exemplary manner in the following.

In the Drawing:

FIG. 1 shows the topology of an embodiment of an electronic dimmer circuit according to the invention.

FIG. 1 is the schematic representation of the topology of an electronic dimmer circuit 01, the representation being considerably simplified and only serving to explain the inventive features. In the embodiment shown, the dimmer circuit 01 has an input channel 02, on which DMX signals for specifying the light power of five lighting means 04 to be adjusted by the dimmer circuit 01 may be received with a DMX data interface 03. The light power of the various lighting means 04 that are to be dimmed is encoded in the DMX signals. After they reach the DMX data interface 03, the DMX control signals are received and processed further in a low-voltage microcontroller 06. After it is received at the DMX data interface 03, the DMX signal is decoded, processed if necessary, and the data assigned to the various lighting means to be dimmed is routed to the various output channels 05.

Two data links 07 and 08 are assigned to each output channel 05, and these links enable the low-voltage microcontroller 06 to exchange data with the high-voltage microcontrollers 09, one of which is provided in each output channel 05. In this context, particularly the control data for specifying the light power of the various lighting means 04 is transmitted from the low-voltage microcontroller 06 to the high-voltage microcontroller 09 via the data link 07. Sensor data may be transmitted in the opposite direction from the high-voltage microcontroller 09 to the low-voltage microcontroller 06 via the data link 08.

Since the high-voltage microcontroller 09 works at a much higher voltage level than the low-voltage microcontroller 06, a separating element 10 is interposed in each data link 07 and 08. This separating element 10 contains two optocouplers 21 and transfers the information signals losslessly, but it provides for a galvanic separation of the voltage potentials between the high-voltage microcontroller 09 and the low-voltage microcontroller 06.

The high-voltage microcontroller 09 is connected with the high alternating voltage for electrically supplying the lighting means 04 via a measuring line 11, which means that the zero crossing of the alternating voltage may be measured and evaluated in the high-voltage microcontroller. Depending on this zero crossing, and taking into account the light power level set in each case, a pulse width modulation is calculated in the high-voltage microcontroller for phase controlled modulation or inverse phase controlled modulation, and this is then transmitted to a switch 13 via a line 12. The switch 13 is then opened and closed for the appropriate phase on the basis of this pulse width modulation to set the respective desired light power on the lighting means 04.

The high-voltage microcontroller 09 may scan the electrical states in the high-voltage range of the lighting means 04 via a measuring line 14, and may generate sensor data from them. This sensor data may then be transmitted to the low-voltage microcontroller 06 via the data link 08. Of course it is easily possible to collect a multitude of sensor data, such as voltage, current intensity, or temperature, even using a plurality of sensor lines 14, and then to transmit them together to the low-voltage microcontroller 06 via the one data link 08.

In order to provide the high-voltage microcontroller 09 with the required supply voltage, the separating element 10 is equipped with a transmission channel 15, via which the supply voltage of for example 5 V may be galvanically separated while it is transmitted from the low-voltage microcontroller 06 to the high-voltage microcontroller 09. A memory chip 16 is integrated in the high-voltage microcontroller 09, and program routines and other data may be stored and read into this chip.

In order to supply electrical power to the dimmer circuit 01, a power supply unit 17 is provided, that delivers direct voltage of 5 V, for example. A display device 18 is provided to display states of the dimmer circuit 01. The graphical data for controlling the display device 18 is calculated by a graphical processor 19 that is integrated in the low-voltage microcontroller. In order to be able to obtain a more detailed evaluation of the sensor data that is transmitted from the high-voltage microcontroller 09 to the low-voltage microcontroller 06 via the data link 08, a network interface 20 is integrated in the low-voltage microcontroller 06, which network interface may be connected to an Ethernet data network.

The invention claimed is:

1. An electrical dimmer circuit comprising:

the electrical dimmer circuit for dimming the electrical power of a plurality of lighting means having at least one digital input channel, at which digital low-voltage input signals for specifying the light power of the various lighting means can be received, and having at least two output channels, on which output signals for dimming the electrical power of the respectively assigned lighting means can be output by pulse width modulation of a high alternating voltage, wherein the electronic dimmer circuit has a low-voltage microcontroller in which the digital low-voltage input signals can be processed, and wherein the electronic dimmer circuit has one high-voltage microcontroller for each of the at least two output channels, which high-voltage microcontroller calculates the pulse width modulation for the assigned output channel and outputs it as a high-voltage output signal, and wherein the low-voltage microcontroller can transmit control data to the high-voltage microcontroller via a first data link, and wherein the high-voltage microcontroller can transmit sensor data to the low-voltage microcontroller via a second data link, and wherein at least one separating element is interposed in each of the data links between the high-voltage microcontroller and the low-voltage microcontroller, which separating element separates the voltage potentials between the high-voltage microcontroller and the low-voltage microcontroller from each other.

2. The electronic dimmer circuit according to claim 1, wherein the separating element contains at least two optocouplers, via which the data signals transmitted in each of the data links can be separated galvanically during transmission.

3. The electronic dimmer circuit according to claim 2, wherein the separating element has a transmission channel, particularly a DC-DC converter, for transferring a supply voltage from the low-voltage microcontroller to each individual high-voltage microcontroller.

4. The electronic dimmer circuit according to claim 1, wherein a display device for displaying state data is connected to the low-voltage microcontroller.

5. The electronic dimmer circuit according to claim 4, wherein the display device has a resolution of at least 320×240 pixels.

6. The electronic dimmer circuit according to claim 4, wherein a graphics processor with which graphical data can be calculated for the display device is integrated in the low-voltage microcontroller.

7. The electronic dimmer circuit according to claim 1, wherein at least one DMX data interface for receiving DMX signals specifying the light power of the lighting means is provided on the digital input channel.

8. The electronic dimmer circuit according to claim 1, wherein the low-voltage microcontroller has a data interface with which the sensor data received from the high-voltage microcontroller can be forwarded.

9. The electronic dimmer circuit according to claim 8, wherein the data interface is designed in the form of a network interface, particularly in the form of an Ethernet network interface.

10. The electronic dimmer circuit according to claim 1, wherein the high-voltage microcontroller is connected to the high alternating voltage for supplying the lighting means via a measuring line, wherein the zero crossing of the alternating voltage is measured via the measuring line for the calculation of the pulse width modulation by the high-voltage microcontroller, and wherein the pulse width modulation for dimming the lighting means is calculated in the high-voltage microcontroller on the basis of the zero crossing and is output as a high-voltage output signal.

11. The electronic dimmer circuit according to claim 1, wherein the dimmer circuit is arranged on a single board.

* * * * *